United States Patent [19]

Behre et al.

[11] Patent Number: 5,025,872

[45] Date of Patent: Jun. 25, 1991

[54] CORE BARREL ADJUSTING SYSTEM

[75] Inventors: Hans-Ulf Behre, Winsen/Aller; Jakob Laukart, Celle, both of Fed. Rep. of Germany

[73] Assignee: Baker Hughes Incorporated, Houston, Tex.

[21] Appl. No.: 451,090

[22] Filed: Dec. 15, 1989

[30] Foreign Application Priority Data

Dec. 24, 1988 [DE] Fed. Rep. of Germany ..... 3843800

[51] Int. Cl.[5] ..... E21B 25/02

[52] U.S. Cl. ..... 175/246; 285/93; 285/298

[58] Field of Search ..... 175/244, 246, 249; 285/93, 298

[56] References Cited

U.S. PATENT DOCUMENTS 4,300,643 11/1981 Lambot ..... 175/244

4,463,460 8/1984 Arnold et al. ..... 285/298 X

FOREIGN PATENT DOCUMENTS 0174615 3/1986 European Pat. Off. .

326352 5/1972 U.S.S.R. ..... 175/246

*Primary Examiner*—William P. Neuder

*Attorney, Agent, or Firm*—Michael Polacek

[57] ABSTRACT

The present invention comprises a novel core drilling tool system which allows for less stressful extended axial settings and adjustments in a core barrel environment. More particularly, the present invention discloses the formation of the setting device as a separate spacer apparatus which provides a setting method independent of the suspension of the inner unit in the outer housing of a core drilling tool thereby allowing for axial settings over a long adjustment path which are generally free of stress due to the weight of the inner unit.

7 Claims, 1 Drawing Sheet

CORE BARREL ADJUSTING SYSTEM

BACKGROUND OF THE INVENTION

The present invention pertains to a novel core drilling tool system which allows for less mechanically stressed axial settings and adjustments in the inner unit of a core barrel.

In a known core drilling tool, as described in U.S. Pat. No. 4,300,643, the conical setting threads of the setting device also form the connector threads for supporting the inner unit in the outer housing. A tubular shoulder of the inner unit, including an axial lock groove at its outside into which locking pawls can be inserted from above by a cylindrical locking element, protrudes upward into a region over the setting threads. The pawls also protrude over the lower edge of the locking part and can be fit into slits in a lower shoulder of an expanded inner hole of the outer housing. To make an adjustment, one has to screw the outer housing onto a separation point located near the adjuster, insert a key from above into the lower tool section and mesh it with the inner unit, lift the lock, and then twist and axially adjust the inner unit.

Adjustments to this design require a large torque on the key because the complete weight of the inner element rests on the thread area of the adjuster threads. This practically eliminates any adjustment of heavy inner units, e.g. those with long inner tubes. In addition, the adjusting device is covered during adjustments and cannot be checked visually for proper operation.

This problem also applies to another known core drilling tool, as disclosed in European Patent No. 0174 615, where the shoulder of the inner element protrudes over the common setting and connecting threaded joint between the inner element and the outer housing. The shoulder is slit and thus provides spreader tongues with outer locking pawls which mesh with axial locking grooves disposed on the inside of the outer housing when a spreader element is screwed in.

SUMMARY OF THE INVENTION

In contrast to the prior art, the present invention provides a core drilling tool which allows for axial settings of the inner tube over a long adjustment path and which is generally free of stress due to the weight of the inner unit.

The formation of the setting device as a separate spacer unit provides a setting method independent of the suspension of the inner unit in the outer housing. This design can be implemented on core drilling tools of any type. When the outer housing is separated from the upper and of the outer part of the spacer unit, the inner part of the spacer unit is exposed for optical inspection during the adjusting process. The inner tube can be independently secured below the setting threads so that the setting threads do not support its weight. In this manner, precise settings can be made over a large range by using little force. This is of particular importance especially for very long inner tubes and/or for those made of special materials, e.g. plastic or aluminum.

Furthermore, due to its design as a separate spacer unit, the adjuster can be adapted individually to a variety of core drilling tools. This adaptability is independent of other functions such as bracing in the outer housing. The spacer unit can also be used at any suitable location between the connection point of the inner unit and the gearing device for the inner tube. Therefore, the present invention's uses are not restricted but extend to all core drilling tools having an outer housing and an inner unit braced in it.

BRIEF DESCRIPTION OF THE DRAWINGS

A sample design of the present invention is illustrated in the following figures.

DETAILED DESCRIPTION OF THE INVENTION

Figure 1:
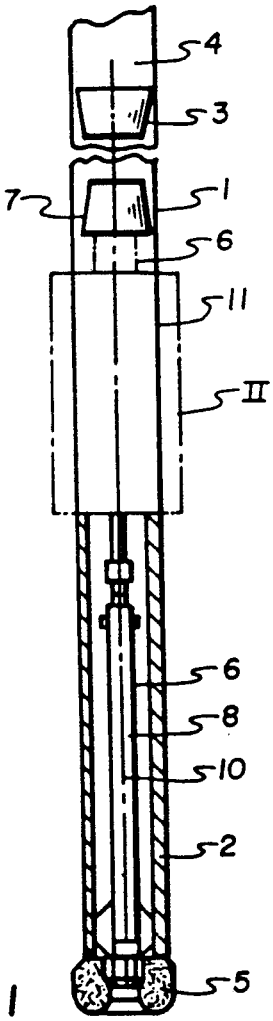
FIG. 1: A partial cut-away side view of a cross-section of a core drilling tool disclosed by the present invention.

The core drilling tool illustrated in FIG. 1 is comprised of standard outer housing 2 which includes several segments screwed together and an upper end which is connectable to a drill string 4 via connectors 3, e.g. by a threaded connection. The tubular outer housing 2 is provided on its lower end with a core drilling bit 5 which can be screwed thereon.

An inner unit 6 is supported at its upper end at a connection point 7 inside the outer housing 2; for example, by being screwed to it. If the core drilling tool 1 is designed as a cable core drilling tool, then the entire inner unit 6 can be pulled up out of the wellbore as is known in the art. The inner unit 6 has a lower component comprising an inner tube 8 for holding the drilled core. The inner tube 8 can rotate freely about its longitudinal axis and thus the tool main axis 10 and also relative to the upper part of the inner unit 6 via a bearing device 9.

Figure 3:
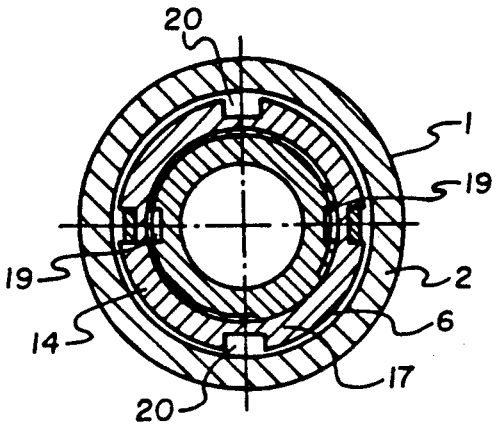
FIG. 3: A cross-section view along line III—III of FIG. 2.
Figure 2:
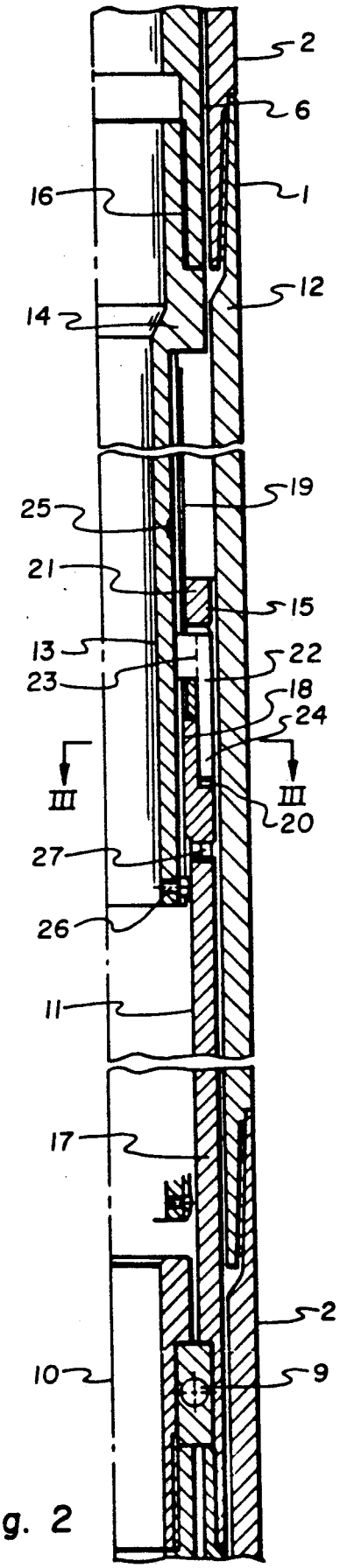
FIG. 2: An enlarged partial cut-away view of section II of FIG. 1 through the core drilling tool at the level of its setting mechanism.

Section II of the core drilling tool 1 as indicated in FIG. 1 is illustrated in more detail in FIGS. 2 and 3. FIG. 2 shows the setting device 11 as a separate spacer unit. The setting device 11 can be inserted into the core drilling tool 1 at a suitable place between connecting point 7 for the inner unit 6 and the bearing device 9 for inner tube 8. The setting device 11 is comprised of an outer part 12 set into the outer housing 2 designed as a spacer tube and screwed in between the neighboring parts of outer housing 2 and inner part 13.

The inner part 13 has an upper setting tube part 14 with outer threads 15 along its lower main part and outer threads 16 at its upper end. The inner part 13 further comprises a lower setting tube part 17 which is provided, at least in its upper region, with inner threads 18. Outer threads 15 and inner threads 18 of the screwed together setting tube parts 14 and 17 form a setting thread which allows an axial screw setting of the one setting tube part 14 relative to the other setting tube part 17.

The upper setting tube part 14 further includes a pair of diametrically opposed axial locking grooves 19 intersecting the outer thread 15 along the axis of the outer housing 2. The lower setting tube part 17 is provided at the outside of its upper region with axial locking grooves 20. Four paired and diametrically opposing locking grooves 20 are preferred.

A retaining nut 21, under which there is a ring locking element 22, is screwed on along the outer threads 15 of the upper setting tube part 14. The locking element 22 can slide along the outer thread 15 of upper setting tube 14 and, using inward-directed locking pawls 23 provided at its upper end, lock into locking grooves 19 of the upper setting tube part 14.

By using the axially downward protruding locking pawls 24, the locking element 22 can move into its locking position from above to mesh with the locking grooves 20 of the lower setting tube part 17. In the locked position of locking element 22, the upper and the lower setting tube parts 14 and 17 are secured against rotational motion. Furthermore, when in the locked position, as shown in FIG. 2, locking element 22 is secured by retaining nut 21 against any upward motion.

Markings 25 can be provided on the locking grooves 19 of the upper setting tube part 14. These make it possible to check the size of any intended adjustments by measuring the distance between the top side of the retaining nut 21 and the markings 25. By using a setting procedures, a gap of desired size, e.g. 4 mm, can be set or reset between the lower end of inner tube 8 and the core drilling bits 5 to ensure the passage of drilling fluid therebetween without an overly large gap to contaminate the core.

Further, with reference to FIG. 2, a safety screw 26 with its head recessed in locking groove 19 is positioned at the lower end of at least one locking groove 19 of the upper setting tube part 14. An access opening sealed by a recessed screw plug 27 is provided in the lower setting tube part 17 which allows a screwdriver passage to the safety screw 26.

To make an adjustment after determining the existing gap size by, for example, direct measurement, one needs to grip the outer housing 2 in the area below the upper end of spacer tube 12 on the rotary table of a drilling tower and loosen its screw connection to the upper part of the outer housing 2. The upper part of the core drilling tool 1 can then be lifted along with its inner unit 6 until the adjusting device 11 is exposed. Then, the inner unit 6 should be supported on the lower part of housing 2 in the areas below setting threads 15 and 18 to thereby release the weight against setting threads 15 and 18. The retaining nut 21 should then be backed off along the outer thread 15 of the upper setting tube part 14 and the locking element 22 pushed axially upward thereby releasing the locking mesh.

The upper setting tube part 14 can then be screwed against the lower setting tube part 17 in order to produce the desired setting or adjustment. Locking element 22 should then be moved downward back to its locked position and the retaining nut 21 screwed down until solid pressure by locking element 22 is applied to the upper end of the lower setting tube part 17. After the upper tool part is then lowered, the outer housing 2 can be screwed back on and the core drilling tool with an adjusted gap between the end of the core tube 8 and the core tube bit 5 is ready for operation.

In the foregoing specification, this invention has been described with reference to a specific exemplary embodiment thereof. It will be evident, however, that various modifications and changes may be made thereunto without departing from the broader spirit and scope of the invention as set forth in the appended claims. The specifications and drawings included here are, accordingly, to be regarded in an illustrative rather than in a restrictive sense.

What is claimed is:

1. A method for adjusting the axial setting of a core drilling tool, said core drilling tool comprising an upper part and a lower part, an inner unit secured to said upper part, and an axial setting device, said method comprising the steps of:

removing the upper part and the inner unit of said core drilling tool thereby exposing the axial adjustment device, said device including setting threads, a locking element, and an upper and lower setting tube part;

releasing the weight of the lower part of said tool on the axial setting threads;

releasing the locking element;

screwing the upper setting tube part against the lower setting tube part in order to produce the desired setting or adjustment;

relocking said locking element; and replacing the inner unit and the upper part of the core drilling tool.

2. A core drilling tool comprising a tubular outer housing with an upper end connectable to a drill string and a lower end connectable to a core drill bit, said housing including an inner tube for holding a drilled core, said inner tube forming the lower component of an inner unit, said unit including an upper component by which the inner unit is supported in said outer housing, the lower component being rotatably suspended from said upper unit and said lower component being axially adjustable relative to said outer housing by the use of a setting device including first and second mutually engaged threaded axial adjustment means and locking means including locking pawls which are engageable with locking grooves associated with said first and second adjustment means, the outer housing being divided at the level of the setting device and an outer part of the setting device being designed as a spacer tube screwed into and between the upper and lower parts of the outer housing with the first and second adjustment means of the setting device comprising an upper setting tube part with outer threads and a lower setting tube part with inner threads, wherein the upper setting tube part has axial locking grooves extending essentially over the length of its outer threads and the lower setting tube part includes axial locking grooves on its outside, said tool including a locking element which can shift axially along the upper setting tube part and includes first locking pawl means which can interlock with said axial locking grooves in the upper setting tube part and second locking pawl means to mesh in the locking grooves of the lower setting tube part.

3. The core drilling tool of claim 1, wherein the upper setting tube part has one pair and the lower setting tube part has two pairs of diametrically opposed locking grooves.

4. The core drilling tool of claim 3, further including a safety nut located above the locking element, said safety nut being located on and engaged with the outer thread of the upper setting tube part.

5. The core drilling tool of claim 4, further including adjustment marking provided in the upper setting tube part.

6. The core drilling tool of claim 5, further including a safety screw positioned at the lower end of at least one locking groove of an upper setting tube part, the head of said safety screw being recessed in the locking groove.

7. The core drilling tool of claim 6, wherein the lower setting tube part includes an access opening sealed by a recessed screw plug.

* * * * *

UNITED STATES PATENT AND TRADEMARK OFFICE

CERTIFICATE OF CORRECTION

PATENT NO. : 5,025,872

DATED : June 25, 1991

INVENTOR(S) : Hans-Ulf Behre, Jakob Laukart

It is certified that error appears in the above-identified patent and that said Letters Patent is hereby corrected as shown below:

Column 4, line 49, the claim reference numeral "1" should read --2--.

Signed and Sealed this

Third Day of November, 1992

*Attest:*

DOUGLAS B. COMER

*Attesting Officer*

*Acting Commissioner of Patents and Trademarks*